United States Patent [19]

Beskin et al.

[11] 4,039,738

[45] Aug. 2, 1977

[54] DEVICE FOR CHARGING AN ELECTRIC ARC FURNACE THROUGH ITS INNER ELECTRODE PIPE AND PERMITTING CONNECTION OF ADDITIONAL LENGTHS OF PIPES THERETO

[76] Inventors: Mikhail Davydovich Beskin, ulitsa Kolomenskaya, 7, kv. 7; Anatoly Timofeevich Pevtsov, Zanevsky prospekt, 43, kv. 36; Lev Grigorievich Nakhamkis, Zanevsky prospekt, 32, kv. 176; Yakov Efimovich Morgovsky, Krasnoputilovskaya ulitsa, 19, kv. 37; Natalya Genrikhovna Bat, ulitsa Bolshaya Porokhovskaya, 44, korpus 3, kv. 56, all of Leningrad, U.S.S.R.

[21] Appl. No.: 615,192

[22] Filed: Sept. 22, 1975

[51] Int. Cl.[2] ..... H05B 7/14

[52] U.S. Cl. ..... 13/33; 13/18

[58] Field of Search ..... 13/18, 33

[56] References Cited

U.S. PATENT DOCUMENTS

| | | | |
|---|---|---|---|
| 1,640,735 | 8/1927 | Soderberg | 13/18 |
| 3,471,626 | 10/1969 | De Weese et al. | 13/18 X |
| 3,604,826 | 9/1971 | Muller et al. | 13/18 |

*Primary Examiner*—H. N. Envall, Jr.

[57] ABSTRACT

Apparatus for charging an electric arc furnace comprising a casing with side charging pipe and two holes in the casing one in the bottom portion of the casing for mounting the device on the electrode inner pipe, and the other in the upper portion of the casing covered by a valve which can be moved between open and closed positions. In the closed position the valve is pressed from below to close the upper hole, and in the open position it is pivoted downwardly for insertion in the hole of an additional length which is joined at its lower end to the electrode inner pipe. Access is provided to the interior of the electrode and to the sub-electrode space of the furnace while preventing emission of toxic furnace gases from the furnace into the atmosphere.

6 Claims, 10 Drawing Figures

DEVICE FOR CHARGING AN ELECTRIC ARC FURNACE THROUGH ITS INNER ELECTRODE PIPE AND PERMITTING CONNECTION OF ADDITIONAL LENGTHS OF PIPES THERETO

FIELD OF THE INVENTION

The present invention relates to electric arc furnaces and more particularly to devices for charging said furnaces through an electrode inner pipe.

The present device can be most effectively used for charging furnaces for the electrothermic production of calcium carbide, phosphorus, ferroalloys, etc.

BACKGROUND

It is known that hollow electrodes comprise an electrode body proper and an inner pipe forming an electrode channel through which the furnace is charged.

The advantages of charging furnaces through hollow electrodes are well-known. However, in the course of the furnace operation some problems arise. One of these lies in the fact that the electrodes are continuously moved vertically to control the electric power of the furnace and, as the electrodes are being consumed, they are lowered and additional lengths are added i.e. they are built-up over certain time intervals dependent on the furnace operating conditions. When the electrodes are built-up the electrode inner pipe is built-up, too. To accomplish the addition of lengths or building-up of the inner pipe, the charging of the furnace must be stopped and the inner pipe closed, due to the fact that toxic gases are emitted from the furnace.

To close the inner pipe shutters are now used which remain in the electrode and ultimately, go into the melt together with the electrode.

The melting-down of this requires the a constant replacement of shutters, which is not economical. In addition, the melting-down of undesirable materials (i.e. the shutters) contaminates the melt which is undesirable for the furnace operation.

These effects can be partially eliminated by a device for charging a furnace through an electrode inner pipe (c.f., see FRG patent No. 1257308 cl. F - 23k). This device comprises a casing with a side pipe for charging, and with coaxial holes one of which is provided in the bottom portion of the casing and is intended for putting the casing on the electrode inner pipe, and the other hole is provided in the upper portion of the casing and is tightly covered by a closing means to prevent the leakage of furnace gas. The closing means is in the form of an elastic plug secured on a long rod and positioned above or below the side pipe for intake of charge.

As charging of the furnace requires access to the electrode channel and to the sub-electrode space of the furnace for cleaning the channel or probing, the use of the plug which is permanently above it or in its upper portion prevents this access.

The long rod used for moving, compressing or extending said plug in the electrode channel causes difficulties in servicing. Furthermore, the case of repair and replacement of the plug it is necessary to open the channel. This inevitably involves emission of toxic furnace gases which can harm the operating personnel.

SUMMARY OF THE INVENTION

The main object of the present invention is to provide a device for charging an electric arc furnace through an electrode inner pipe, which permits the attachment of additional length i.e. the building-up of hollow electrodes while providing access to the electrode channel. and to the sub-electrode space of the furnace, said access being required for cleaning the channel or for probing.

Another no less important object of the invention is to prevent the electrode channel from being in communication with the atmosphere during all of the operations mentioned above.

Still another object of the invention is to provide a device, simple in design and reliable in exploitation, which prevents the emission of toxic furnace gases.

These and other objects of the invention are provided by a device for charging an electric arc furnace through an electrode inner pipe of this furnace, which comprises a casing with a side pipe for intake of charge and gas and with coaxial holes one of which is provided in the bottom portion of the casing for mounting the casing on the electrode inner pipe, and the other hole is provided in the upper portion of the casing and is covered with a closing means for preventing the furnace gas from leaking; and according to the invention, the closing means comprises a valve located inside the upper portion casing of the with the capability of being displaced between two positions; in one of these positions, during charging, the valve is closely pressed from below against the hole in the upper portion of the casing and covers it; and in the other position the valve is moved downwardly for insertion through the hole of a length of pipe to be joined at its lower end to the electrode inner pipe, said length of pipe having on its other end a screw cap for preventing the emission of furnace gases during the building-up operation; said screw cap being positioned with the capability of moving along the pipe axis.

The proposed construction ensures access to the electrode channel and to the sub-electrode space of the furnace, fast and effective building-up of the electrode inner pipe, and prevents the emission of toxic gases. This is due to the construction wherein the valve covering the hole makes it possible to charge the furnace without the electrode channel in communication with the atmosphere. The insertion into the hole of a length of pipe with a cap screwed on its upper portion ensures pressurization of the device and a fast and effective buildingup of the electrode inner pipe.

Furthermore, according to the invention, a seal is fixed on the valve, as the side where the hole is sealed, and above said hole there is a lid with a seal, mounted on the casing with the capability of being moving between two positions, in one of which the lid closes the hole during charging and in the other position the lid opens the hole while the electrode inner pipe is being built-up. The use of said seals on the valve and in the bottom portion of the casing, as well as the lid with the seal, positioned so that it closes the hole makes it possible to safely pressurize the device and prevent the emission of gas into the ambient atmosphere when charge is fed through the electrode inner pipe. The lid being in an open position enables fast insertion of the length of pipe with the cap screwed thereon into the hole with the seal, the valve being subsequently moved downwardly. The provision of flat elastic rings whose diameter is less than the external diameter of the electrode inner pipe is necessary for a better pressurization preventing the leakage of furnace gases.

To ensure a free passage of charge into the electrode inner pipe, the device must be mounted at a given height relative to the top end of this pipe, and at the same time this device must be fixed on the electrode inner pipe. For this purpose, in the upper portion of the length of the pipe to be inserted, on its outside surface, at some distance from its end, there is provided an annular groove into which is inserted at least one spring stop positioned in the bottom portion of the casing, and there is also provided a split ring in the form of a clamp whose arms have holes to enable a swivel screw to pass through them.

BRIEF DESCRIPTION OF THE DRAWING

The invention will be further a specific embodiment thereof, with reference to the accompanying drawings, wherein.

DETAILED DESCRIPTION

Figure 1:
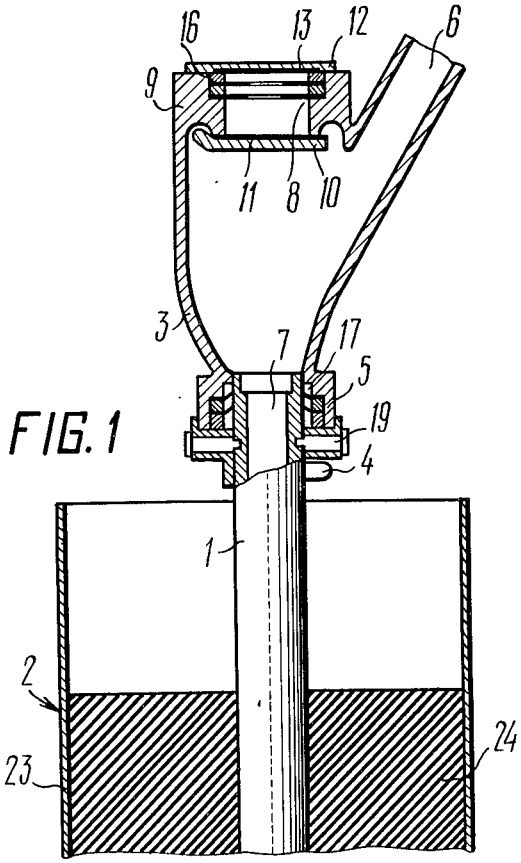
FIG. 1 is a front view, partly broken away and in section of a device for supplying a charge into an inner electrode pipe.

FIG. 1 shows a device for supplying charge through an inner pipe 1 of an electrode 2 which comprises a casing 3 secured on the inner pipe 1 of the electrode 2 by means of a clamp 4 carried at a bottom portion 5 of the casing 3. This casing comprises a side pipe 6 for charging, material into the hollow interior of the inner pipe 1 of electrode 2. The casing 3 is also provided with which one hole 7 is provided in said bottom portion 5 of the casing 3, and another hole 8 is provided in an upper portion 9 of the casing. Said side pipe 6 is adapted for being connected with a pipe for supplying charge (not shown). The hole 8 is covered by a spring valve 10 positioned inside the casing 3 in its upper portion 9 with the possibility of being displaced between two positions. In one of these positions, during charging, said valve 10 is pressed from below against said hole 8; at the surface where the valve is pressed against the hole there is provided a seal 11 secured on said valve 10.

Figure 2:
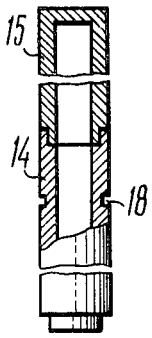
FIG. 2 shows a length of pipe with a screw cap; partly broken away and in section adapted for being attached to the inner electrode pipe.
Figure 3:
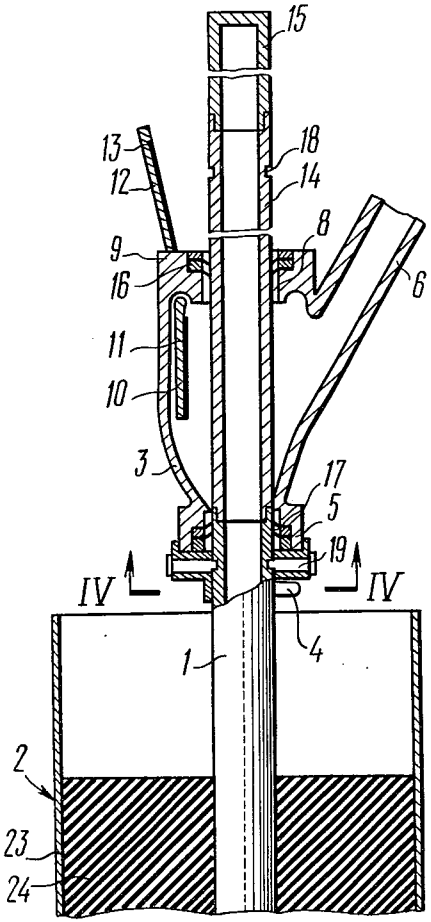
FIG. 3 shows the device in FIG. 1, with the length of pipe with the screw cap in FIG. 2 inserted therein, during the building-up of the electrode inner pipe.

The use of the valve pressed against the hole and said seal 11 prevents the leakage of furnace gases during charging. Above hole 8 there is provided a hinged lid 12 with a seal 13, fixed on said casing 3 with the possibility of being displaced between two positions; in one of these positions it covers the hole 8 during charging and in the other position it opens the hole, that is, it is opened, as shown in FIG. 3 for passage of a length pipe 14 inserted into the hole and adapted for connection with pipe 1 to provide additional length therefor; at this moment said valve 10 with said seal 11 is in the second or open position, that, is, it is displaced downwardly, as shown in FIG. 3. Said length of the pipe 14 (FIG. 2) is inserted during the addition to the length of pipe 1, i.e. the building-up of the inner electrode pipe 1 and pipe 14 has a diameter equal to that of pipe 1. A cap 15 is screwed on the top end of the length of pipe 14 to prevent the leakage of furnace gases during building-up. This screw cap is positioned with a possibility of moving along the axis of pipe 14 to be removed during the joining of this pipe at its lower end with the inner pipe 1 of electrode 2 (FIG. 3). The joining of pipes 14 and 1 is implemented by screwing them together without taking them out from said casing 3. To prevent the leakage of furnace gases, seals 16 are provided in the upper portion 9 of said casing 3 where the pipe 14 is inserted into said hole 8; said seals 16 are in the form of flat elastic rings, the diameter of the holes in the ring being less then the external diameter of the pipe 14 to be inserted therein. Such a provision of the seal is necessary for reliable prevention of the leakage of furnace gases during the building-up of the inner electrodes pipe. A seal 17 in the form of flat elastic rings with a hole diameter less than the external diameter of inner pipe 1 of electrode 2 is secured in the bottom portion of the casing also for preventing the leakage of furnace gases between the bottom portion 5 of casing 3 and inner pipe 2 both during building-up and charging.

To ensure a free passage of charge into the inner pipe 1, the device is mounted at a given height in relation to the top end of this pipe. For the purpose, a circular groove 18 is provided in the upper portion of pipe 14, at some distance from its end; at least one spring stop 19 placed in the bottom portion 5 of said casing 3 is inserted into said circular groove 18.

Figure 4:
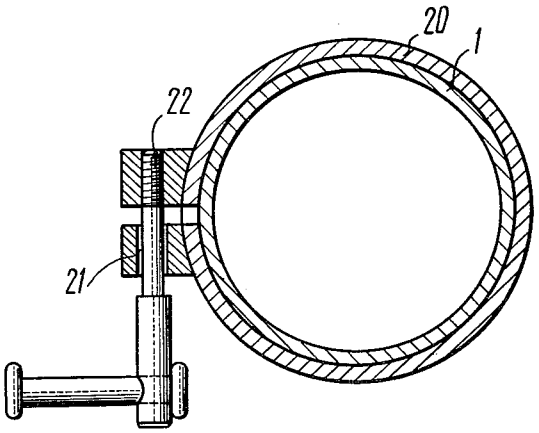
FIG. 4 is a section taken on line IV—IV in FIG. 3.

The clamp 4 serves to fix the device on the inner pipe 1 of electrode 2 and prevent it from rotating thereon. Any known means can be used for this clamp, for example, a split ring 20 (FIG. 4) in the form of a clamp whose arms have holes 21 for the passage of a screw 22. The electrode 2 has, in addition to inner pipe 1, a jacket 23 with a filled-in electrode mass 24, which jointly form the electrode body.

Figure 5:
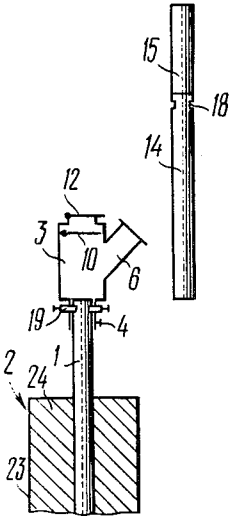

The device operates as follows. As FIG. 5, shows, charge is fed through side pipe 6 of the device into inner pipe 1 of electrode 2.

The device is secured when stops 19 are engaged in groove 18 of the pipe 14 (which in this case is said inner pipe 1 of electrode 2), and secured with said clamp 4 on this pipe at a given height relative to its top edge. The spring valve 10 and the hinged lid 12 are closed; the place where the bottom portion 5 of the casing 3 is joined with the inner pipe 1 of electrode 2 is sealed.

Thus, the leakage of furnace gases from the electrode 2 is prevented.

Before starting the building—up of the inner pipe 1 of electrode 2 charging must be stopped.

Figure 6:
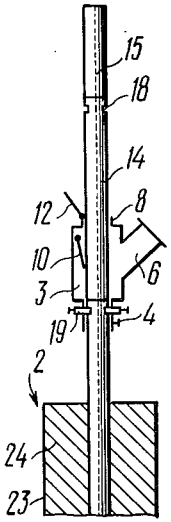

The removable cap 15 is screwed on the upper end of the length of pipe 14 to be added. Then, the hinged lid 12 is opened (FIG. 6) and the length of pipe 14 with the screw cap 15 thereon is inserted into the circular seal of hole 8 at the upper portion of the casing 3. At this moment disconnection of the channel of electrode 2 with the atmosphere is ensured by the seal between inner pipe 1 and casng 3, and between the length of pipe 14 and casing 3 jointly with the closed spring valve 10.

After said spring valve 10 is displaced downwards the length of pipe 14 to be added is moved until it stops and is screwed into the inner pipe 1 of electrode 2.

At this moment disconnection of the electrode channel with the atmosphere is ensured by the seal between casing 3 and the pipe 14, and between casing 3 and the inner electrode pipe 1 of said electrode 2.

Figure 8:
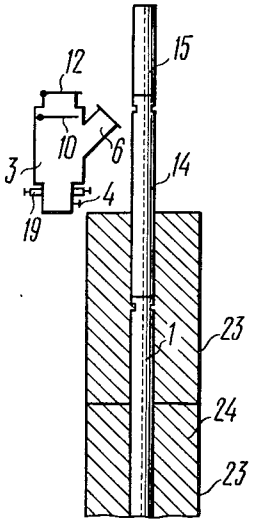
Figure 7:
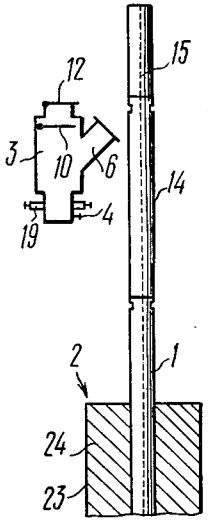

Then, clamp 4 is released, said spring stops 19 (FIG. 7) are removed from the groove 18 of the electrode pipe 1, the device 3 is lifted upwards, removed from the added length of pipe 14 and separated, together with the charging pipe 6 from electrode 2 in order not to hinder the building-up of jacket 23 of electrode 2 and the filling-in of the electrode mass 24, as shown in FIG. 8.

In this position, the inner pipe is covered with screw cap 15, thus preventing the leakage of furnace gases from the furnace.

Figure 10:
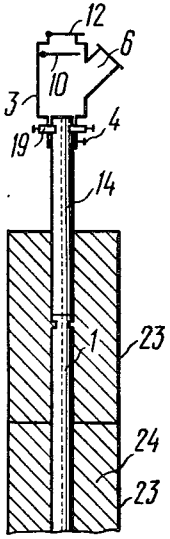
FIGS. 5 through 10 show the operational sequence during the building-up of the electrode inner pipe.
Figure 9:
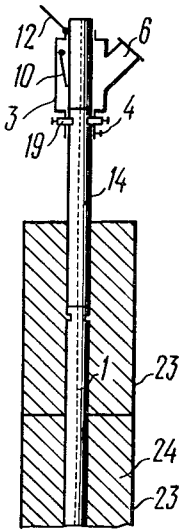

After jacket 23 (FIG. 9) of electrode 2 is built-up and the electrode mass 24 filled-in, the device 3 is put on screw cap 15, with hinged lid 12 and valve 10 in open position. Then, the spring stops 19 are placed in working position, and the device is lowered until spring stops 19 enter groove 18 in the upper portion of the added length of pipe 14 whereafter the device 3 is fixed by clamp 4. Then the removable cap 15 is screwed off the added length of pipe 14 and raised. At this moment the spring valve 10 closes. Then the screw cap 15 (FIG. 10) is taken out of the seal, hinged lid 12 with its seal is closed, after which charging of the furnace through the inner pipe 1 of electrode 2 is continued.

For cleaning the channel, probing, etc., the required tools ar led into the electrode channel and the sub-electrode space of the furnace through upper seal 16 (FIG. 1) above spring valve 10, said valve being subsequently opened in the direction of the channel of the electrode 2.

The tools are taken out in a reverse order.

Similar to the process of the building-up of the inner pipe 1 of electrode 2 the, tools are introduced and taken out without communication between the channel of the electrode 2 with the atmosphere.

What we claim is:

1. A device for charging an electric arc furnace through an inner electrode pipe of the furnace, said device comprising a casing including a side pipe for charging the inner electrode pipe, said casing having upper and lower portions and being provided with first and second coaxial holes, one in said bottom portion of said casing and the other hole in said upper portion of said casing; closing means comprising a valve inside said casing in said upper portion for closing said other hole during charging and being displaceable to a position in which said hole is opened, a length of pipe to be coupled to said inner electrode pipe to lengthen the same, said length of pipe having upper and lower ends and being insertable into said other hole in the upper portion of the casing to be joined at its lower end to said inner electrode pipe, and a screw cap on the upper end of said length of pipe to prevent the leakage of furnace gases during the joining of said pipes and being capable of moving along the axis of said length of pipe.

2. A device as claimed in claim 1 comprising a seal secured to said valve on the side thereof for closing said hole, a lid with a seal mounted on said casing above said hole for displacement between a first position in which said lid covers said hole during charging, and a second position in which said lid opens said hole for entry of said length of pipe to be joined to the inner electrode pipe.

3. A device as claimed in claim 1 wherein said length of pipe has a circular groove in said upper portion on the external surface, said groove being located at a distance from the upper end of said length of pipe; at least one spring stop positioned in the bottom portion of said casing for being inserted into said circular groove to fix said device at a given height relative to the upper end of said pipe, and clamping means for clamping said device to said length of pipe.

4. A device as claimed in claim 3 wherein said clamping means comprises a clamp engagable on said length of pipe and including radial arms with aligned holes therein, and screw means engageable in said holes for clamping said arms together.

5. A device as claimed in claim 1 wherein said valve is spring loaded and normally urged to close said hole.

6. A device as claimed in claim 1 comprising seal means in said upper portion of the casing at said other hole for sealing said length of pipe in said casing when said length of pipe is inserted into said other hole.

* * * * *